US006798348B1

(12) United States Patent
Wilker et al.

(10) Patent No.: US 6,798,348 B1
(45) Date of Patent: Sep. 28, 2004

(54) ERGONOMICALLY DESIGNED TOOL HANDLE

(76) Inventors: Scott Wilker, 139 Central Ave., Glen Rock, NJ (US) 07452; Judith Bergner, 29 Arrowwood Cir., Rye Brook, NY (US) 10573; Kenneth R. Altberg, 2 Crestwood Dr., Danbury, CT (US) 06011; Ronald S. Hollister, 6A Hobson St., Danbury, CT (US) 06810

( * ) Notice: Subject to any disclaimer, the term of this patent is extended or adjusted under 35 U.S.C. 154(b) by 0 days.

(21) Appl. No.: 10/405,601

(22) Filed: Apr. 3, 2003

(51) Int. Cl.[7] ..... G08B 21/00

(52) U.S. Cl. ..... 340/691.1; 340/692; 340/691.7; 16/110.1; 16/406; 16/430

(58) Field of Search ..... 340/691.1, 692, 340/691.7; 16/110.1, 406, 430

(56) References Cited

U.S. PATENT DOCUMENTS

| | | | | | |
|---|---|---|---|---|---|
| 845,592 | A | | 2/1907 | Stewart | 294/57 |
| 3,751,094 | A | | 8/1973 | Bohler | 294/58 |
| 3,888,535 | A | | 6/1975 | Rosso | 294/19 R |
| 3,933,346 | A | | 1/1976 | Carver | 269/4 |
| 4,701,142 | A | | 10/1987 | Merritt | 440/101 |
| 4,704,758 | A | | 11/1987 | Hoffman | 15/144 B |
| 4,958,407 | A | | 9/1990 | Johnson | 16/114 R |
| 5,060,343 | A | * | 10/1991 | Nisenbaum | 16/111 R |
| 5,125,130 | A | | 6/1992 | Stanish | 16/110 R |
| 5,133,101 | A | | 7/1992 | Hauser et al. | 15/143.1 |
| 5,159,769 | A | * | 11/1992 | Odorisio | 37/278 |
| 5,315,724 | A | | 5/1994 | Trujillo et al. | 7/145 |
| 5,400,471 | A | | 3/1995 | Lichfield et al. | 16/114 R |
| 5,432,978 | A | | 7/1995 | Menke et al. | 16/114 R |
| 5,474,350 | A | | 12/1995 | Gauthier | 294/58 |
| D369,083 | S | | 4/1996 | Tallman | D8/300 |
| 5,542,183 | A | * | 8/1996 | Allison | 30/276 |
| 5,740,613 | A | * | 4/1998 | Swistun et al. | 30/276 |
| 5,810,408 | A | * | 9/1998 | Armstrong | 294/57 |
| 5,959,792 | A | * | 9/1999 | Ibrahim | 359/872 |
| 6,199,245 | B1 | | 3/2001 | Blessing | 16/430 |
| 2002/0116761 | A1 | | 8/2002 | Grady et al. | 16/444 |

FOREIGN PATENT DOCUMENTS

| | | |
|---|---|---|
| DE | 506625 | 9/1930 |
| DE | 3517538 A1 | 4/1945 |
| GB | 568515 | 4/1945 |
| GB | 686252 | 1/1953 |

* cited by examiner

*Primary Examiner*—Toan N. Pham
(74) *Attorney, Agent, or Firm*—Richard C. Litman

(57) ABSTRACT

An ergonomically designed handle or angled attachment for use with a tool or implement. The ergonomically designed handle includes an elongate member having distal and proximate ends, plural angular portions along the elongated member positioned intermediate the distal and proximate ends, and is configured to emit an audible and/or visual signal. The ergonomically designed handle or angled attachment may include a power source, memory, a central processing unit (CPU), sensor(s), audible indicator(s), light source(s), switch(es), camera(s), a transceiver, a microphone, notch(es), and aromatic element(s). The power source may be one or more batteries (rechargeable or non-rechargeable), and may be removable or non-removable. The ergonomically designed handle or angled attachment may also be configured to withstand a predetermined blast limit.

20 Claims, 6 Drawing Sheets

ERGONOMICALLY DESIGNED TOOL HANDLE

BACKGROUND OF THE INVENTION

1. Field of the Invention

The present invention generally relates to handles of tools or implements and, more particularly to ergonomically designed handles to reduce stress on the hands and wrist to avoid undue fatigue.

2. Description of the Related Art

Hand tools or implements are used on a daily basis at home and at work. People use them to dig holes, shovel driveways, rake leaves or to perform other tasks. Prolonged use of "non-optimal" hand tools can often be linked to repetitive strain injuries. These kinds of injuries and/or discomfort are often the result of repetitive or static hand work, awkward postures, using tools that have sharp edges or which are heavy and unsuspended, the exertion of force to the hand, vibrations, poor handle design, or simply using an improper tool for a task.

The handle of a tool or implement is the interface between the tool or implement and the user. The design of the handle can contribute significantly to the effectiveness of the tool or implement. The grip of a tool or implement often dictates its use. For example, smaller tools or implements with a precision grip are often used in fine manipulation tasks. Tools that allow for a power grip are better to exert force. If the handle is too long for the hand, increased force will be placed on the wrist joint. If the handle is too small, pressure points can occur in the muscle tissues of the hand and fingers. Conventional handles have a straight configuration aligned along the longitudinal axis of the tool or implement's shaft.

The related art is represented by the following references of interest.

U.S. Design Pat. No. 369,083, issued on Apr. 23, 1996 to Ronald Tallman, shows an ornamental design for a cam action handle. The Tallman patent does not suggest an ergonomically designed tool handle according to the claimed invention.

U.S. Patent Application Publication No. 2002/01167791 A1, published on Aug. 29, 2002 for Grady et al., describes an illuminated grab handle assembly that includes a generally curved handle, an illumination source positioned remotely from, and for illuminating, the generally curved handle. The Grady et al. application does not suggest an ergonomically designed tool handle according to the claimed invention.

U.S. Pat. No. 845,592, issued on Feb. 26, 1907 to Frank Stewart, describes a shovel handle with a handgrip or handhold at a point intermediate its ends. The Stewart patent does not suggest an ergonomically designed tool handle according to the claimed invention.

U.S. Pat. No. 3,751,094, issued on Aug. 7, 1973 to Gerard M. Bohler, describes an auxiliary handle which is readily securable to a regular handle of an implement. The Bohler patent does not suggest an ergonomically designed tool handle according to the claimed invention.

U.S. Pat. No. 3,888,535, issued on Jun. 10, 1975 to Charles Russo, describes a fireman's pike pole with a head of generally triangular configuration with a longitudinally extending pointed portion and a laterally extending hook. The Russo patent does not suggest an ergonomically designed tool handle according to the claimed invention.

U.S. Pat. No. 3,933,346, issued on Jan. 20, 1976 to Leonard J. Carver, describes a sensor alarm including a sensor for detecting heat, smoke, noxious gases, and the like and an alarm for warning of an alarm condition coupled to the sensor. Black does not suggest an ergonomically designed tool handle according to the claimed invention.

U.S. Pat. No. 4,701,142, issued on Oct. 20, 1987 to William Merritt, describes a handle to the shaft of a paddle that has a grip portion and spaced outwardly extending arms on the grip portion. The Merritt patent does not suggest an ergonomically designed tool handle according to the claimed invention.

U.S. Pat. No. 4,704,758, issued on Nov. 10, 1987 to Charles W. Hoffman, describes adjustable handle constructions for long handled implements. Hoffman does not suggest an ergonomically designed tool handle according to the claimed invention.

U.S. Pat. No. 4,958,407, issued on Sep. 25, 1990 to Samuel V. Johnson, describes an auxiliary tool handle for attachment to cylindrical tool handles. The Johnson patent does not suggest an ergonomically designed tool handle according to the claimed invention.

U.S. Pat. No. 5,125,130, issued on Jun. 30, 1992 to Walter F. Stanish, describes an ergonomic handle for tools and sporting equipment. The Stanish patent does not suggest an ergonomically designed tool handle according to the claimed invention.

U.S. Pat. No. 5,159,769, issued on Nov. 3, 1992 to Nicol Odorisio, describes materials handling devices. Odorisio does not suggest an ergonomically designed tool handle according to the claimed invention.

U.S. Pat. No. 5,315,724, issued on May 31, 1994 to Mark Trujillo et al., describes a combination fire axe that includes an elongated handle, a head member disposed at one end of the handle, and a pike member disposed at the opposite end of the handle. The Trujillo et al. does not suggest an ergonomically designed tool handle according to the claimed invention.

U.S. Pat. No. 5,400,471, issued on Mar. 28, 1995 to William H. Lichfield, describes an auxiliary handle for use on a hand held implement. The Lichfield patent does not suggest an ergonomically designed tool handle according to the claimed invention.

U.S. Pat. No. 5,432,978, issued on Jul. 18, 1995 to W. Kenneth Menke et al., describes a fire fighting tool with a handle that is removably and adjustably attached to a pole. The Menke et al. patent does not suggest an ergonomically designed tool handle according to the claimed invention.

U.S. Pat. No. 5,474,350, issued on Dec. 12, 1995 to Serge Gauthier, describes a three-part auxiliary shaft assembly. The Gauthier patent does not suggest an ergonomically designed tool handle according to the claimed invention.

U.S. Pat. No. 6,199,245 B1, issued on Mar. 13, 2001 to Kenneth C. Blessing, describes a multi-component handle to obtain a handle configuration desired by a user for a particular application. The Blessing patent does not suggest an ergonomically designed tool handle according to the claimed invention.

German Patent document 506,625, published on Aug. 28, 1930, shows a tool handle for an axe. The German '625 document does not suggest an ergonomically designed tool handle according to the claimed invention.

Great Britain Patent Application No. 568,515, published on Apr. 9, 1945, describes handles for tools. The Great Britain '515 application does not suggest an ergonomically designed tool handle according to the claimed invention.

Great Britain Patent Application No. 686,252, published on Jan. 21, 1953, describes handles for brushes, mops, and the like. The Great Britain '252 application does not suggest an ergonomically designed tool handle according to the claimed invention.

German Patent document DE 3,517,538 A1, published on Nov. 20, 1986, describes a working device for people with only one hand. The German '538 document does not suggest an ergonomically designed tool handle according to the claimed invention.

None of the above inventions and patents, taken either singularly or in combination, is seen to describe the instant invention as claimed.

SUMMARY OF THE INVENTION

The present invention is an ergonomically designed handle or angled attachment for a tool or implement to reduce stress on the hands and wrist to avoid undue fatigue. The ergonomically designed handle includes an elongate member having distal and proximate ends, plural angular portions along the elongated member positioned intermediate the distal and proximate ends, and is configured to emit an audible and/or visual signal. The angular portions of the ergonomically designed tool handle or the angled attachment may include a power source, memory, a central processing unit (CPU), sensor(s), audible indicator(s), light source(s), switch(es), camera(s), a transceiver, a microphone, impact tool(s), and aromatic element(s). The power source may be any suitable power source, such one or more batteries (rechargeable or non-rechargeable) or the like, and may be removable or non-removable. Similarly, the memory, CPU, audible indicator(s), light source(s), switch (es), camera(s), transceiver, microphone, impact tool(s), and aromatic element(s) may be any types well known in the art. The angled portions of the ergonomically designed handle or the angled attachment may be intrinsically safe. The angled portions of the ergonomically designed handle or the angled attachment may also be configured to withstand a predetermined blast limit.

Accordingly, it is a principal aspect of the invention to provide an ergonomically designed tool handle or angled attachment that is configured to emit an audible and/or visual signal.

It is another aspect of the invention to provide an ergonomically designed handle or angled attachment that includes a power source, memory, a CPU, sensor(s), audible indicator(s), light source(s), switch(es), camera(s), a transceiver, a microphone, impact tool(s), and aromatic element(s).

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
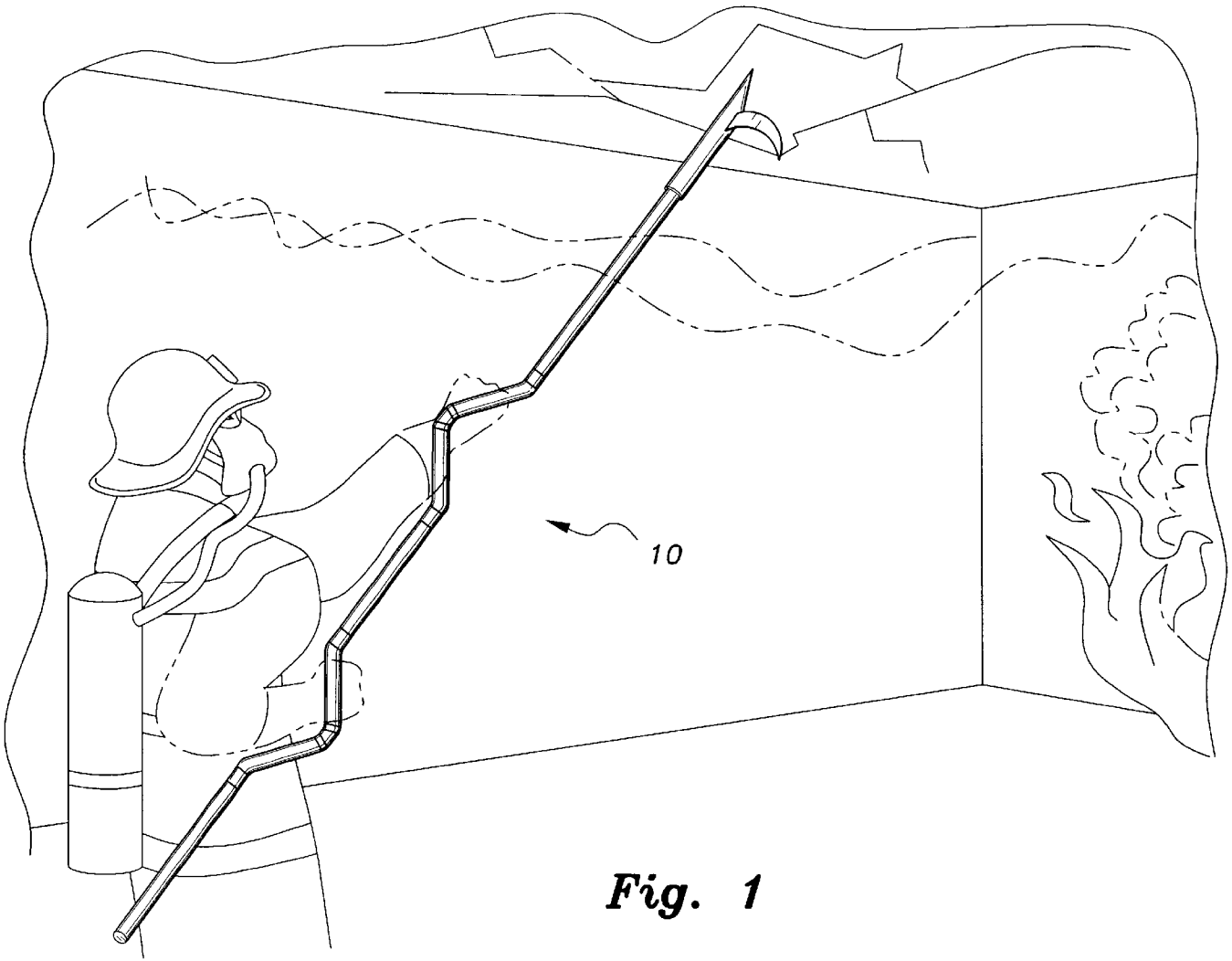
FIG. 1 is an environmental view of a firefighter using a pike pole with an ergonomically designed tool handle according to the present invention.
Figure 2:
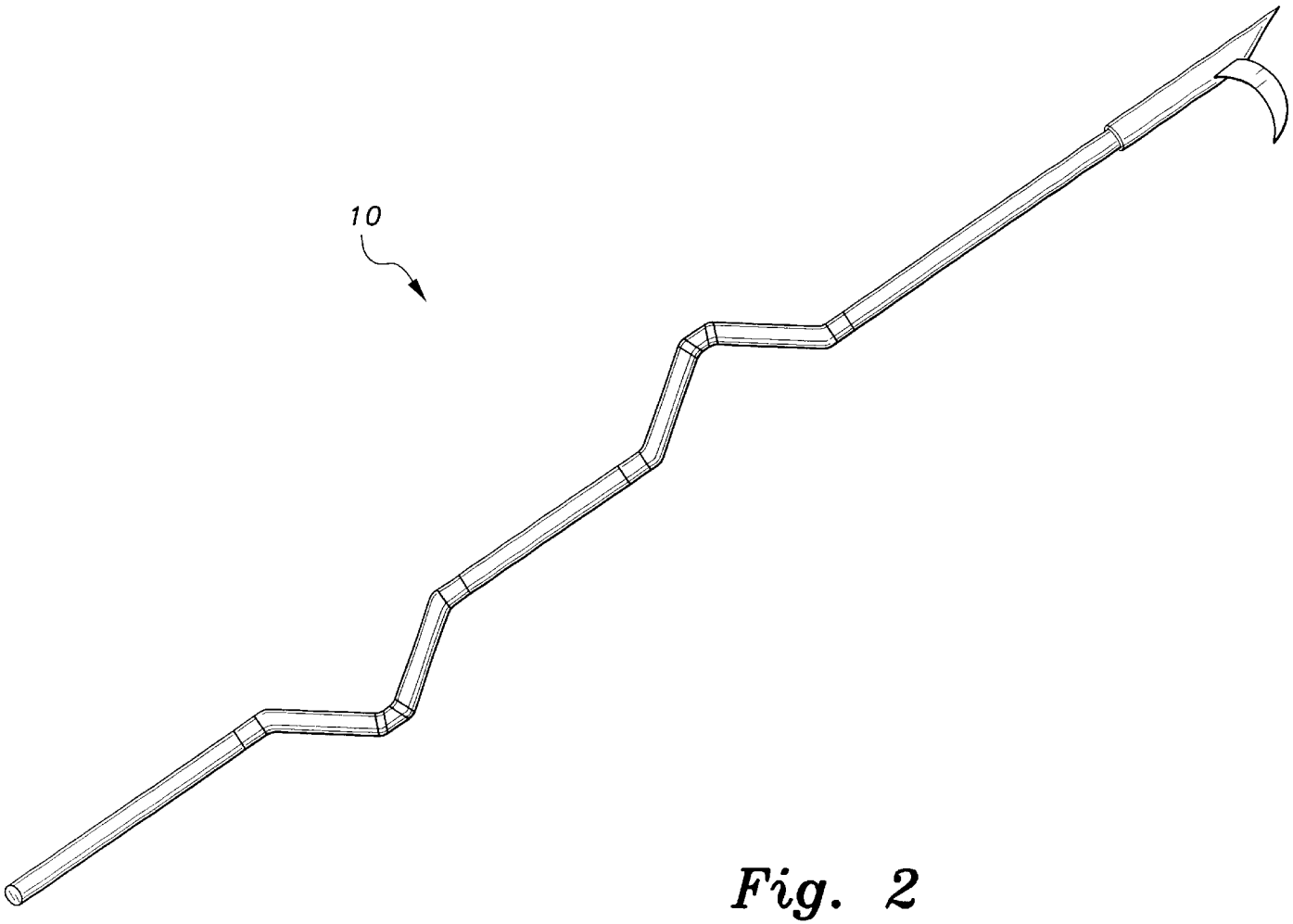
FIG. 2 is a pike pole with an ergonomically designed tool handle according to the present invention.

The present invention is an ergonomically designed handle or angled attachment. The invention disclosed herein is, of course, susceptible of embodiment in many different forms. Shown in the drawings and described hereinbelow in detail is are preferred embodiments of the invention. It is to be understood, however, that the present disclosure is an exemplification of the principles of the invention and does not limit the invention to the illustrated embodiments.

Referring to the drawings, FIG. 1 illustrates a firefighter using a pike pole to pierce a hole in a ceiling of a room of a building that is under fire. The pike pole has an ergonomically designed handle 10 according to the invention. Obviously, the ergonomically designed handle 10 may be used with any other type of tool or implement according to the desires of the user, such as a broom, mop, rake, shovel, or the like. Alternatively, angled attachments 20 may be attached to conventional handles for tools or implements, as shown in FIGS. 3–4C.

Ergonomically designed handle 10 includes an elongate member having distal and proximate ends, plural angular portions along the elongated member positioned intermediate the distal and proximate ends, and is configured to emit an audible and/or visual signal. Ergonomically designed handle 10 includes a tool head forming a pike pole. Ergonomically designed handle 10 is shown with two angular portions. The two angular portions extend from a longitudinal axis of the handle 10 in opposing directions, and are spaced from each other by a predetermined distance according to the desires of the user, such as about eighteen to thirty-six inches or the like,. The angled portions elongate member extend from the longitudinal axis of the handle 10 by a predetermined angle, such as twenty to ninety degrees or the like, according to the desires of the user. For example, a user could configure the angled portions of handle 10 to form a step ladder to enable the user to climb out of an opening in a dangerous area. Ergonomically designed handle 10 may be made from a durable material, such as plastic, metal, wood, or the like, according to the desires of the user. Ergonomically designed handle 10 may also be configured to withstand a predetermined blast limit. The material used for ergonomically designed handle 10 may be opaque or translucent and may be colored according to the desires of the user. For example, ergonomically designed handle 10 may be brightly, fluorescently colored to make it easy to identify work areas, points of egress, or to lead a trail to and from search areas.

Figure 3:
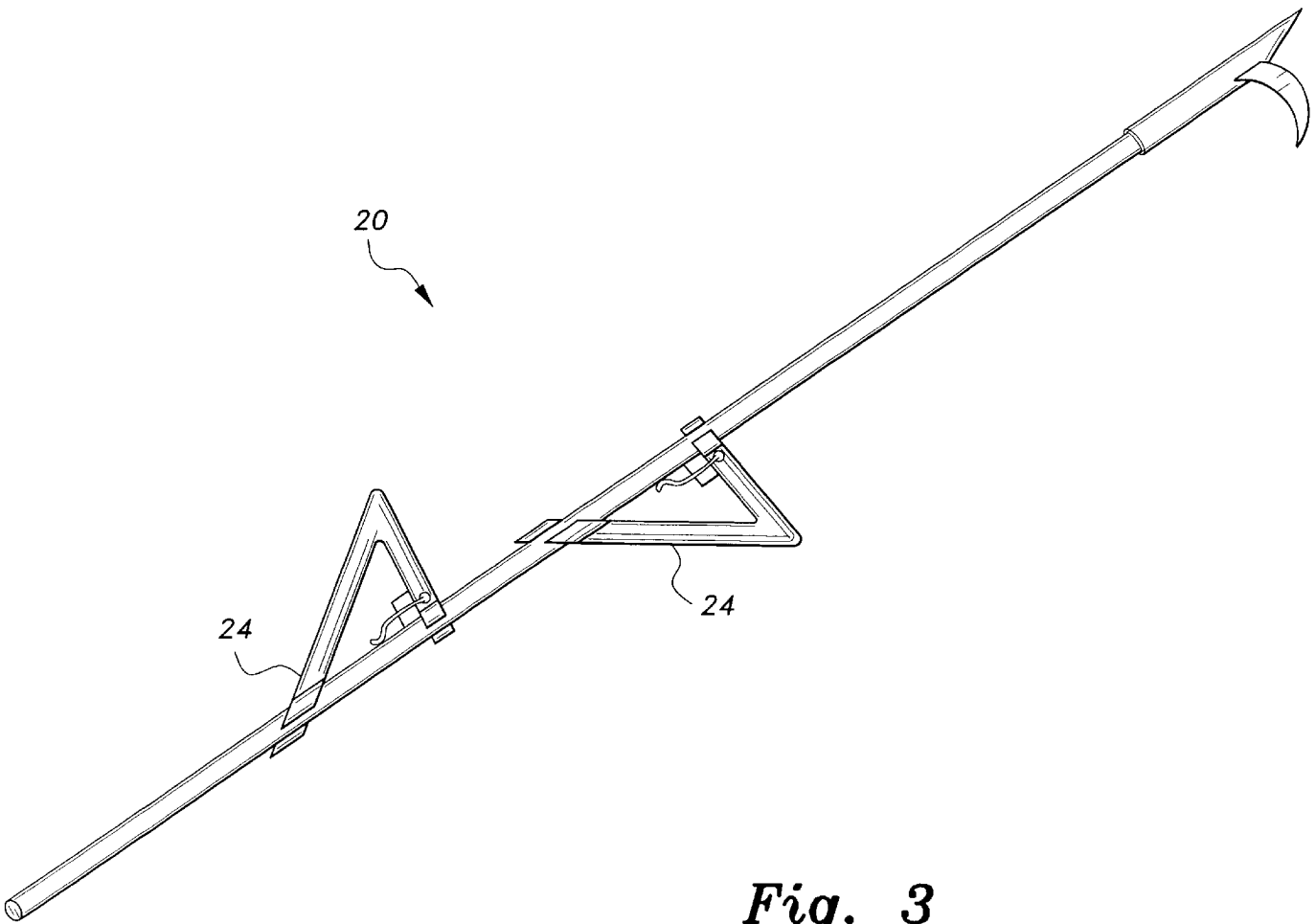
FIG. 3 is a pike pole with a handle having angled attachments according to the present invention.
Figure 4A:
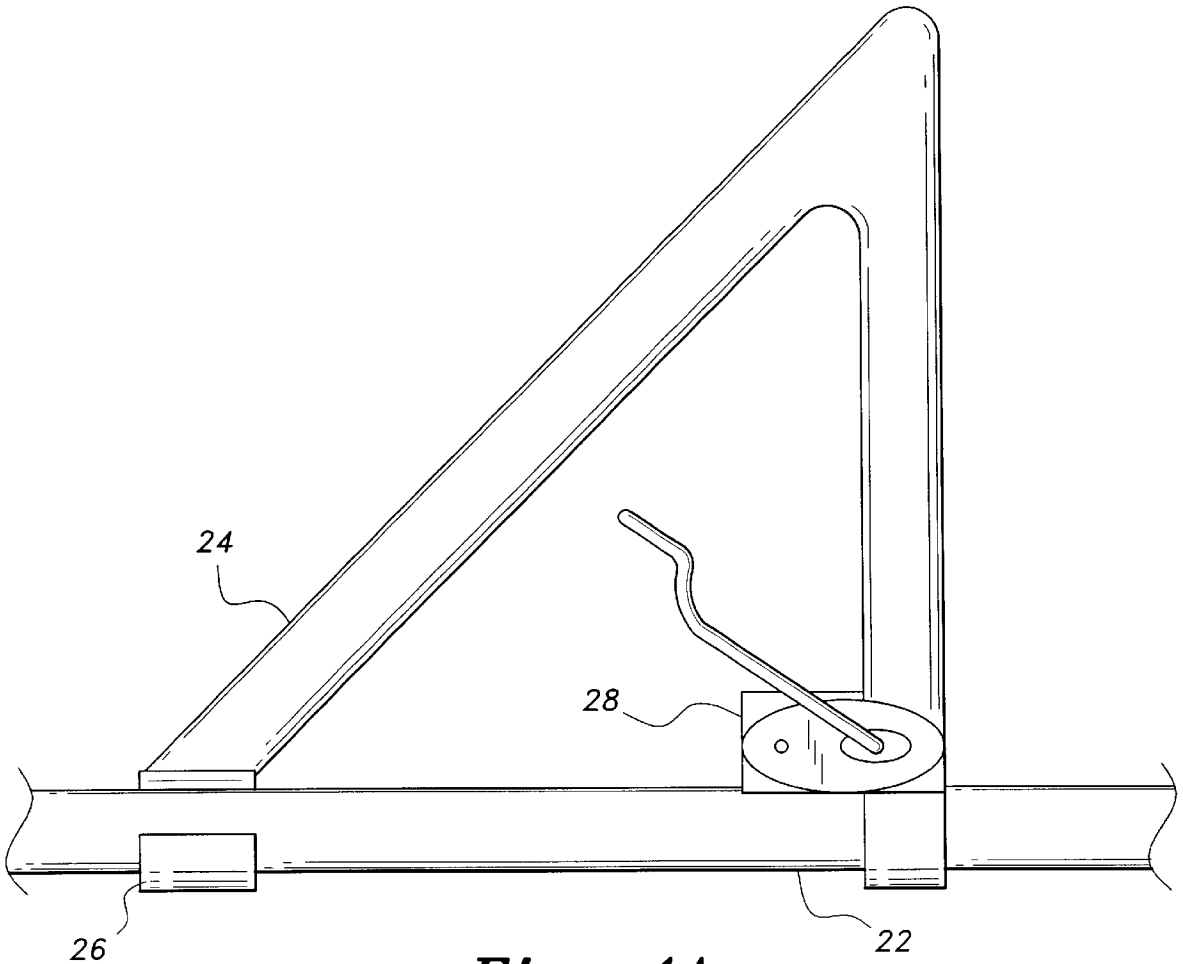
FIG. 4A is a side view of a handle portion and an angled attachment shown in FIG. 3.
Figure 4C:
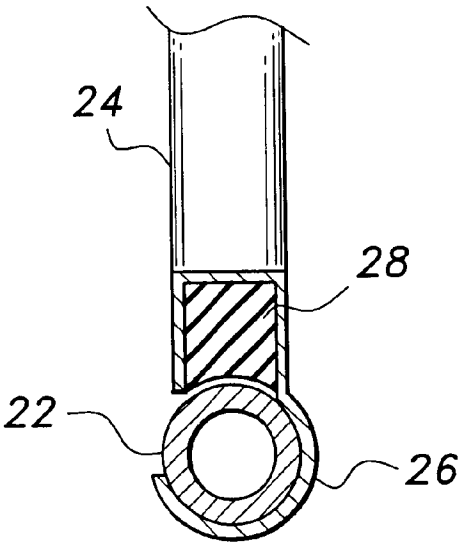
FIG. 4C is a cross-sectional side view of the handle portion and the angle attachment shown in FIG. 4A with a brake in a closed position.
Figure 4B:
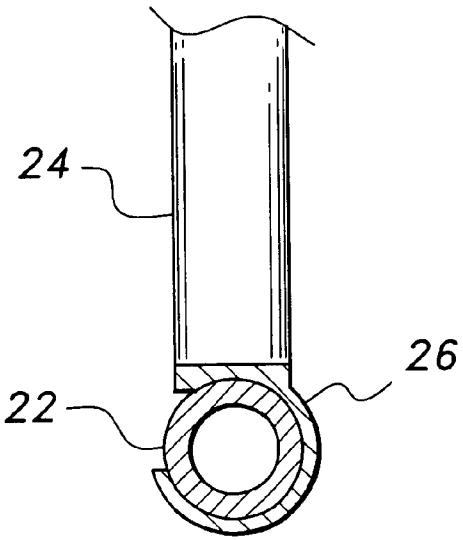
FIG. 4B is a cross-sectional side view of the handle portion and the angle attachment shown in FIG. 4A with a brake in an open position.

Angled attachments 20 for attaching to conventional handles for tools or implements is shown in FIGS. 3–4C. The angled attachments 20 include two arm elements 24 interconnected to form an angle. Each arm element 24 extends from the interconnection point to an end that includes a clamping member. The clamping member may be any type of clamping member, such as grooved notch or the like, configured to enable a user to adjust the position of the angled element along the length of a conventional handle. The handle shown in FIGS. 3–4C is a tubular handle. The clamping members of the angled element 20 have circularly configured grooves that are diametrically larger than the tubular handle, allowing the angled attachment 20 to be readily moved to a desired position along the length of the tubular handle. The angled element also includes a brake 28, which may be configured in the form of a spring loaded release arm or the like. The brake enables a user to lock the angled attachment 20 at a desired position along the length of the tubular handle. Angled attachment 20 may also be configured to withstand a predetermined blast limit. The material used for ergonomically designed handle 10 may be opaque or translucent and may be colored according to the desires of the user. For example, angled attachment 20 may be brightly, fluorescently colored to make it easy to identify work areas, points of egress, or to lead a trail to and from search areas.

Figure 5:
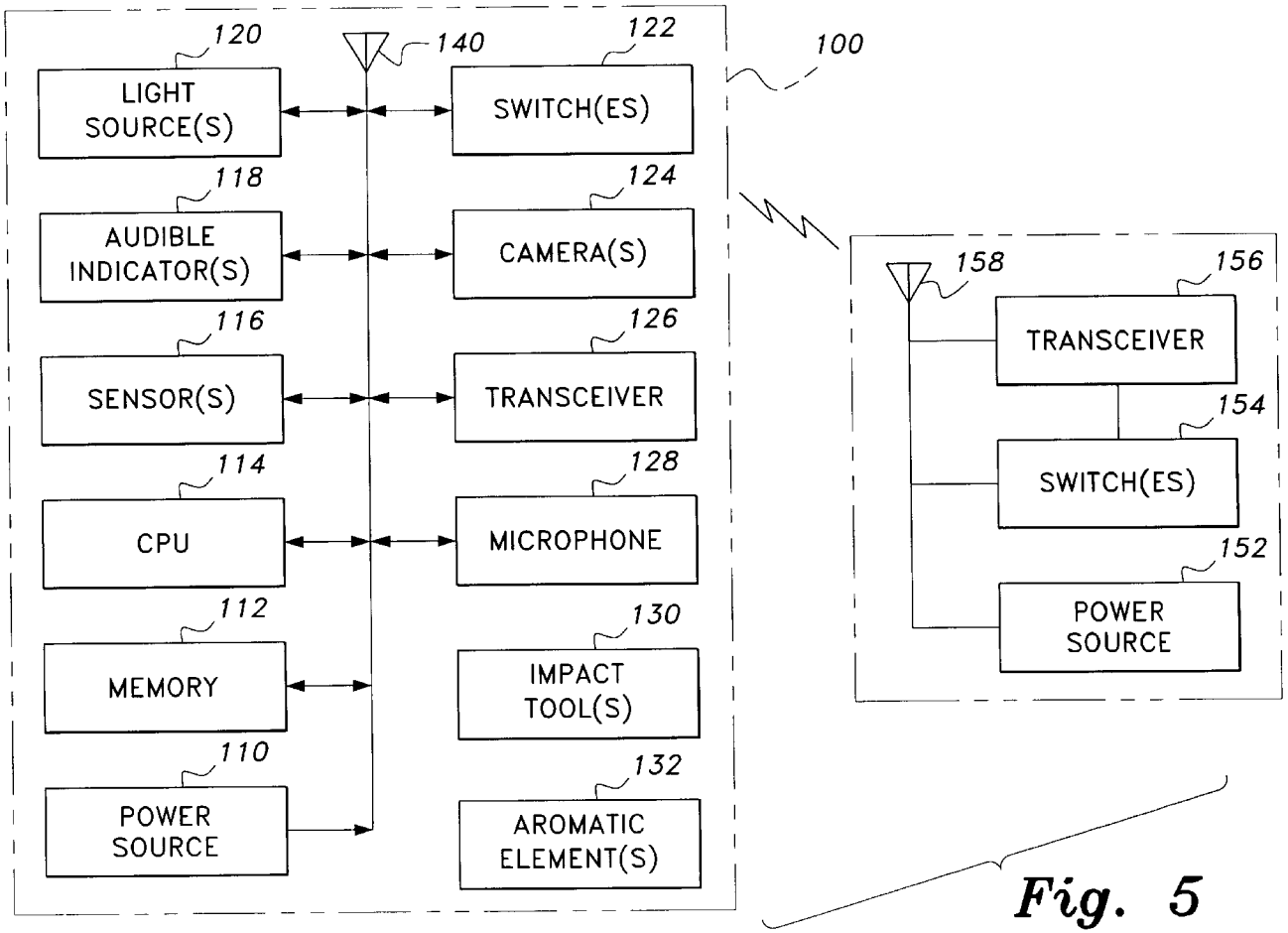
FIG. 5 is a block diagram of an ergonomically designed handle or angled attachment according to the present invention.

As shown in FIG. 5, the angled portions of ergonomically designed handle 10 or angle attachment 20 may also include power source 110, memory 112, CPU 114, sensor(s) 116, audible indicator(s) 118, light source(s) 120, switch(es) 122, camera(s) 124, transceiver 126, microphone 128, impact tool(s) 130, and aromatic element(s) 132. Power source 110 may be any suitable power source, such one or more batteries (rechargeable or non-rechargeable) or the like, and may be removable or non-removable. Similarly, memory 112, CPU 114, audible indicator(s) 118, light source(s) 120, switch(es) 122, camera(s) 124, transceiver 126, microphone 128, impact tool(s) 130, and aromatic element(s) may be any types well known in the art.

CPU 114 may be connected to all of the electrical elements on ergonomically designed handle 10 or angled attachment 20, and controls the movement and process of instructions as well as data in ergonomically designed handle 10 or angled attachment 20. Memory 112 stores instructions and data as CPU 114 processes information. Ergonomically designed handle 10 or angled attachment 20 may also include one or more sensors 116 to detect any desirable condition, such as movement, temperature, smoke, carbon monoxide, or the like. Audible indicator 118 may be a speaker that is powered by an amplifier to emit any distinctive audible sound, such as a buzzer, chirp, chime, or the like. Alternatively, audible indicator 118 may be a speaker that relays any audible communication information, such a recorded message, a relayed communication message, a relayed live transmission, or the like.

Light source(s) 120 may be configured as a flashlight that includes a bulb and a reflector for illuminating an area. Light source(s) 120 may be a strobe light, such as a xenon bulb or the like, that periodically emits a bright light. Angled portions of ergonomically designed handle 10 or angled attachment 20 may be configured to emit light source 24 out of any or all sides of the angled portions or angled attachments 20. Switch 122 may be configured to activate and deactivate light source(s) 120 and/or audible indicator 118 by any well known technique, such as depressing, rocking, rotating, or the like. Power source 110 may be any suitable power source, such one or more batteries (rechargeable or non-rechargeable) or the like, and may be removable or non-removable.

Ergonomically designed handle 10 or angled attachment 20 may also include one or more cameras 124, a transceiver 126, a microphone 128, etc. These elements may be of any type well known in the art. The camera 124 may be a digital camera that converts a captured image into a digital bit stream for storage or transmission. The transceiver 126 can establish two-way communication between ergonomically designed handle 10 or angled attachment 20 and a telephone line by way of antenna 140. The microphone 128 may be used for relaying audio data or for activating one of the indicators on ergonomically designed handle 10 or angled attachment 20 by any well known voice activation technique.

Ergonomically designed handle 10 can be configured to establish two-way communication through the combined use of the microphone 128 and audible indicator 126. In addition, ergonomically designed handle 10 or angled attachment 20 may include one or more notches configured for use ass a wrench or the like. Ergonomically designed handle 10 or angled attachment 20 may include an aromatic element 132 may be provided to emanate a pleasant scent from ergonomically designed handle 10 or angled attachment 20, and may be a scented or aromatic material, such as basil, cinnamon, clove eucalyptus, juniper, lavender, lemon, lime, mint, orange, rose, rosemary, vanilla, or the like.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

We claim:

1. An ergonomically designed handle for use with an implement, said handle comprising:

an elongate member having distal and proximate ends;

plural angular portions along the elongated member spaced from each other by predetermined distances, and positioned intermediate the distal and proximate ends;

at least one signaling device in the elongated member, said at least one signaling device being configured to emit at least one of an audible signal and a visual signal; and a power source.

2. The ergonomically designed handle according to claim 1, wherein said at least one signaling device includes a light source.

3. The ergonomically designed handle according to claim 1, wherein said at least one signaling device includes an audible indicator.

4. The ergonomically designed handle according to claim 1, further comprising at least one sensor.

5. The ergonomically designed handle according to claim 1, further comprising at least one switch.

6. The ergonomically designed handle according to claim 1, further comprising at least one camera.

7. The ergonomically designed handle according to claim 1, further comprising a transceiver.

8. The ergonomically designed handle according to claim 1, further comprising a microphone.

9. The ergonomically designed handle according to claim 1, further comprising at least one aromatic element.

10. The ergonomically designed handle according to claim 1, in combination with a tool head forming a pike pole.

11. An angled attachment for ergonomically enhancing a handle, said angled attachment comprising:

an angular portion having clamping elements for adjustably attaching to the handle;

a brake for setting the angular portion at a predetermined position along the handle;

at least one signaling device in the angular portion, said at least one signaling device being configured to emit at least one of an audible signal and a visual signal; and a power source.

12. The angled attachment according to claim 11, wherein said at least one signaling device includes a light source.

13. The angled attachment according to claim 11, wherein said at least one signaling device includes an audible indicator.

14. The angled attachment according to claim 11, further comprising at least one sensor.

15. The angled attachment according to claim 11, further comprising at least one switch.

16. The angled attachment according to claim 11, further comprising at least one camera.

17. The angled attachment according to claim 11, further comprising a transceiver.

18. The angled attachment according to claim 11, further comprising a microphone.

19. The angled attachment according to claim 11, further comprising at least one aromatic element.

20. The angled attachment according to claim 11, in combination with a handle and tool head forming a pike pole.

* * * * *